United States Patent [19]

Schoener

[11] Patent Number: 4,570,514

[45] Date of Patent: Feb. 18, 1986

[54] SPANNER WRENCH FOR USE WITH A MACPHERSON STRUT RETAINING NUT OR THE LIKE

[75] Inventor: Gilbert P. Schoener, Fargo, N. Dak.

[73] Assignee: Branick Industries, Inc., Fargo, N. Dak.

[21] Appl. No.: 557,600

[22] Filed: Dec. 2, 1983

[51] Int. Cl.[4] ..... B25B 13/06

[52] U.S. Cl. ..... 81/129; 81/90.3; 81/132; 81/170

[58] Field of Search ..... 81/129, 132, 90 C, 170, 81/171; 269/156, 287; 279/112

[56] References Cited

U.S. PATENT DOCUMENTS

| | | | |
|---|---|---|---|
| 761,523 | 5/1904 | Miller | 81/90 C |
| 1,882,462 | 10/1932 | Weber . | |
| 2,389,954 | 11/1945 | Burns | 81/90 C |
| 2,442,920 | 6/1948 | DeVries | 81/90 C |
| 2,586,067 | 2/1952 | LePree | 279/112 |
| 2,991,676 | 7/1961 | Bond . | |
| 3,731,906 | 5/1973 | Beach . | |
| 3,847,042 | 11/1974 | Wilson | 81/17 J |
| 3,857,307 | 12/1974 | Hegel . | |
| 4,012,971 | 3/1977 | Zeyher . | |
| 4,103,531 | 8/1978 | Daniel . | |
| 4,117,709 | 10/1978 | Jackson . | |
| 4,262,562 | 4/1981 | MacNeill | 81/90 C |
| 4,305,570 | 12/1981 | Castoe . | |

FOREIGN PATENT DOCUMENTS

| | | | |
|---|---|---|---|
| 329498 | 10/1919 | Fed. Rep. of Germany | 279/112 |

OTHER PUBLICATIONS

GP 1014, "Spanner Pirate" ®, Adjustable Strut Spanner Wrench Brochure.
Model MSW-523 Brochure.
Model MSW-523-R Brochure.

*Primary Examiner*—James L. Jones, Jr.
*Attorney, Agent, or Firm*—Merchant, Gould, Smith, Edell, Welter & Schmidt

[57] ABSTRACT

A spanner wrench (20) for use in removing and replacing a retaining nut (52) of a cartridge type shock absorber assembly (50) is disclosed. A spanner wrench (20) includes a cylindrical wrench body (22) defining a retaining nut facing end surface (24) and a second end surface opposite therefrom. The wrench body (20) defines an axially directed aperture (28) proximate the center thereof, and a rectangular opening (58) radially removed therefrom. Two elongated handles (36) are interconnected to and extend laterally outwardly from the periphery of the cylindrical wrench body (22). A plurality of radially extending slots (26) are defined in the retaining nut facing end surface (24) of the cylindrical wrench body (22). A plurality of adaptor members (30) configured for removable receipt in the slots (26) are radially slideable in the slots (26). The adaptor members (30) provide for engagement of the retaining nut (52) to be operated on. The adaptor members (30) are configured to enable use of the spanner wrench body (22) with a variety of retaining nut configurations. The spanner wrench further includes means cooperating with the wrench body (22) for releasably securing the adaptor members (30) at selected locations along the slots (26) radially removed from the center of the wrench body (22).

5 Claims, 13 Drawing Figures

FIG. 1
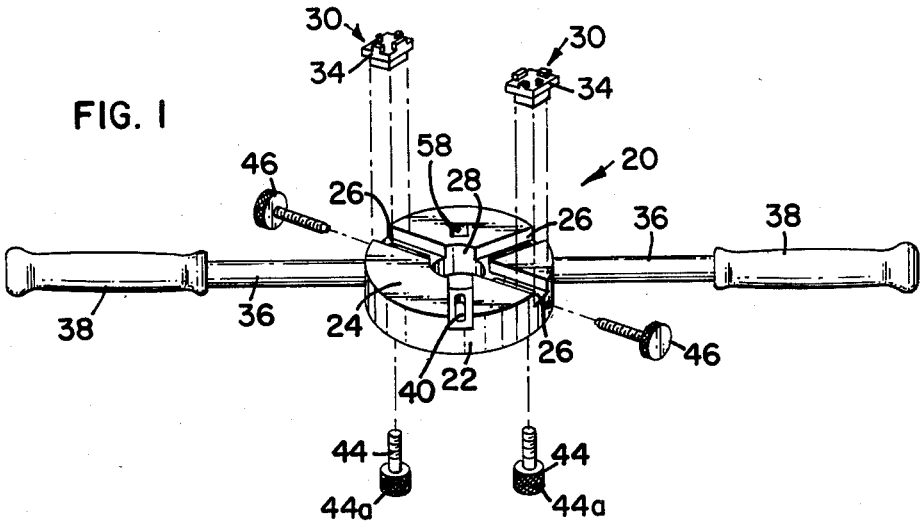
FIG. 2
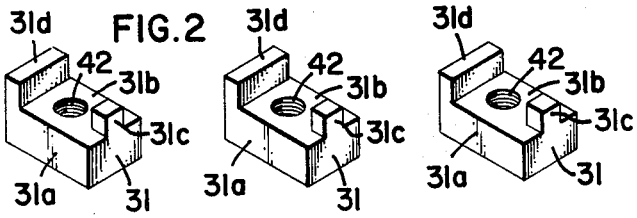
FIG. 3
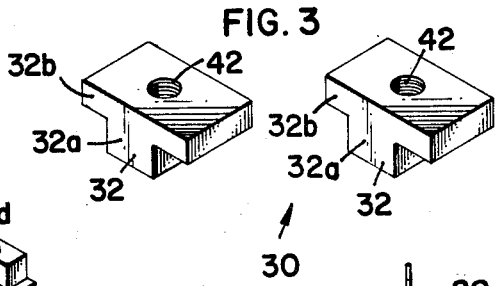
FIG. 4
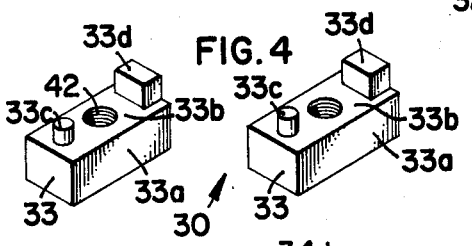
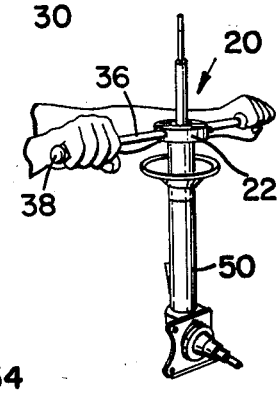
FIG. 6
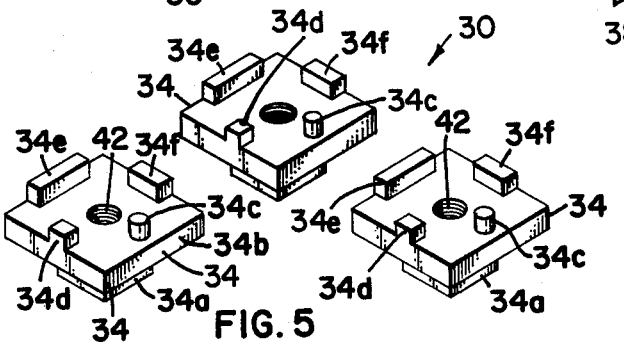
FIG. 5

SPANNER WRENCH FOR USE WITH A MACPHERSON STRUT RETAINING NUT OR THE LIKE

BACKGROUND OF THE INVENTION

The present invention relates to a new and improved Spanner wrench for use in removing and replacing the retaining nut of a MacPherson strut type suspension assembly. More particularly, the present invention features a wrench body with interchangeable adaptors enabling servicing of a wide variety of such suspension assemblies having vrying configurations of retaining nuts.

Cartridge type shock absorbers are well known and generally consist of a tubular shaped housing within which a shock absorber cartridge is operatively disposed. A vehicle suspension spring is frequently mounted coaxially of the tubular housing and cooperates with the shock absorber to cushion the vehicle chassis relative to the axle of the vehicle. Such shock absorber cartridges are typically mounted so as to enable removal from the associated cartridge housings for purposes of replacement, repair, etc. Typically, a retaining nut or the like is threadedly mounted within one end of the cartridge housing such that the retaining nut may be unthreaded to enable insertion or removal of a shock absorber cartridge into the associated housing. Various types of tools for use with retaining nuts have been developed. However, due to the variety of cartridge type suspension assemblies frequently referred to as MacPherson type suspension assemblies, utilizing various shapes and sizes of retaining nuts, a wide variety of tools or wrenches have been required for each of the different shapes and sizes of retaining nuts.

Various attempts have been made to develope a tool which is adjustable to accommodate different types and sizes of shock absorber assemblies. For example, U.S. Pat. No. 1,882,462 issued to Weber discloses a Y-shaped spanner wrench having two spacer arms 12. Jaws 17 are disposed in channels 15 and are laterally adjustable therein. The jaws 17 further include axially extending pins 18 and laterally extending pins 19 for engagement with tool receiving openings in a retaining nut of a shock absorber assembly. In addition to other problems associated with the spanner wrench disclosed in Weber, the wrench has only a single handle which somewhat limits its accessibility and leverage which may be applied. Furthermore, the wrench can only be utilized with retaining nuts wherein the tool receiving openings in the retaining nuts are radially or laterally aligned. For example, if the tool receiving openings of the retainer nuts were offset at one hundred twenty (120) degrees, the wrench disclosed in Weber could not be utilized. Furthermore, the wrench of Weber cannot be used with flat sided retaining nuts or internal hex-shaped retaining nuts.

U.S. Pat. No. 3,857,307 issued to Hegel discloses a retaining nut tool including a pair of longitudinally aligned handle sections 54, 56 and an adjustment member 64 which is slideably mounted on one of the handle sections. As with the Weber patent, the Hegel disclosure requires that the tool receiving openings in the retaining nut be radially or laterally aligned in order for the lug elements 80, 82 to be received therein. Once again, in addition to other problems, there is no provision for use with flat sided retaining nuts or internal hex-shaped retaining nuts.

The present invention solves the above mentioned problems and others associated with prior art devices.

SUMMARY OF THE INVENTION

The present invention relates to a spanner wrench for use in removing and replacing a retaining nut of a cartridge type shock absorber assembly. The invention includes a cylindrical wrench body defining a first retaining nut facing end surface and a second end surface opposite therefrom. The wrench body further defines an axially directed aperture proximate the center thereof. Two elongated handles are interconnected to and extend laterally outwardly from the periphery of the cylindrical wrench body. A plurality of radially extending slots are defined in the first retaining nut facing end surface of the cylindrical wrench body. A plurality of adaptor members are configured for removable receipt in the slots. The adaptor members being radially slideable in the slots and providing for engagement of the retaining nut to be operated on. The adaptor members enable use of the spanner wrench body with a variety of retaining nut configurations. The spanner wrench further includes means cooperating with the wrench body for releasably securing the adaptor members at selected locations along the slots radially removed from the center of the wrench body.

The present invention features an adjustable wrench body utilizing adaptor members enabling service on a wide variety of cartridge type shock absorber assemblies.

Furthermore the present invention insures proper removal, installation and accurate tightening of the retaining nut component to the manufacturer's recommended torque specification. Accordingly, the present invention may be utilized with a wide variety of vehicles using original equipment MacPherson struts as well as after market replacement cartridges having retaining nuts of various shapes and sizes.

In the preferred embodiment of the present invention, the wrench body includes a total of four radially extending slots, three of the slots being angularly spaced substantially one hundred twenty (120) degrees from one another while a fourth of the slots is angularly spaced sixty (60) degrees from two of the slots on either side of the fourth slot. This particular slot configuration allows the spanner wrench of the present invention to be utilized with retaining nuts wherein the tool receiving openings, or blind bores as they are frequently referred to, in the retaining nuts are spaced one hundred twenty (120) degrees apart as opposed to one hundred eighty (180) degrees. Furthermore, the spanner wrench of the present invention can also be utilized with internal hex-shaped retaining nuts such that three adaptor members engage alternating internal flat sides of the retaining nut. The preferred embodiment of the spanner wrench can also be utilized with externally flat sided retaining nuts.

In the preferred embodiment of the present invention, the two handles are longitudinally aligned with one another and are removably threaded into the wrench body. Accordingly, the handles may be removed if additional clearance is required to access the retaining nut. Furthermore, the longitudinally aligned handles enable substantial torque to be applied to the retaining nut.

In the preferred embodiment of the present invention, the adaptor members are secured in position by axially projecting thumb screws which are finger tightened thereby doing away with a requirement for any additional special tools. In addition, the preferred embodiment includes radially projecting thumb screws cooperating with selected ones of said axially projecting thumb screws to facilitate radial adjustment and positioning of the adaptor members.

The present invention provides a spanner wrench tool which is easy to use and readily adaptable to a wide variety of retaining nut configurations. Furthermore, the present invention minimizes the components required.

Furthermore, the wrench of the present invention is relatively inexpensive to purchase and maintain. For example, if an adaptor should break or be lost, only that adaptor need be replaced. Additionally, the present invention is readily adaptable to future retaining nut configurations that might come into use.

One embodiment of the present invention includes multiple sets of adaptor members, the adaptor members within a given set differing from the adaptor members of the other sets. The sets of adaptor members are interchangeable to enable the wrench body to be utilized with a wide variety of retaining nuts.

In yet another embodiment of the present invention, each of the adaptor members include a plurality of retaining nut engaging elements. The adaptor members include a substantially square slot following portion thereby enabling the adaptor members to be positioned within the slots at any one of four orientations angularly displaced by ninety (90) degrees. Accordingly, selected ones of the engaging elements may be made to engage a retaining nut. This embodiment requires only one set of adaptors and thereby further minimizes the components required.

The preferred embodiment of the present invention further includes an axially directed square aperture on the retaining nut facing end surface of the wrench body which functions as an adaptor for attachment of a conventional torque wrench to the wrench body. Accordingly, the retaining nut can be accurately tightened to the manufacturer's specified torque requirements for the retaining nut.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the present invention.

BRIEF DESCRIPTION OF THE DRAWINGS

In the drawings, in which like reference numerals and letters indicate corresponding parts throughout the several views, FIG. 1 is an exploded perspective view of a preferred embodiment of the present invention;

FIG. 2 is a view in perspective of one set of adaptor members for use with an alternate embodiment;

FIG. 3 is a view in perspective of a second set of adaptor members for use with an alternate embodiment;

FIG. 4 is a view in perspective of a third set of adaptor members for use with an alternate embodiment;

FIG. 5 is a view in perspective of a set of adaptor members of the embodiment shown in FIG. 1 capable of performing the retaining nut engagement functions of the adaptor member sets shown in FIGS. 2, 3, and 4;

FIG. 6 is a view in perspective of the embodiment shown in FIG. 1 in use;

DETAILED DESCRIPTION OF THE PREFERRED EMBODIMENT

Figure 7:
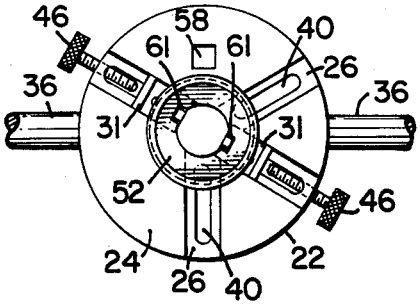
FIG. 7 is a fragmentary top plan view of the adaptor members shown in FIG. 2 being used with an internal notch type retaining nut.

Referring now to FIG. 1, there is shown in an exploded perspective view a preferred embodiment of the spanner wrench of the present invention, generally designated by the reference numeral 20. The spanner wrench 20 includes a cylindrical wrench body 22 having a substantially flat retaining nut facing end surface 24 and a relatively flat end surface (not shown) opposite therefrom. The wrench body 22 includes a plurality of radially extending slots 26 in the end surface 24. The slots 26 extend from an aperture 28 defined in the center of the wrench body 22 to the outer periphery thereof. The slots 26 are configured for removable receipt of adaptors 30 which are radially slideable in the slots 26. Illustrated in FIGS. 2 through 5 are four different adaptor types 31, 32, 33, and 34 respectively, which can be utilized with the slots 26 and which will be described hereafter in more detail.

As illustrated in FIG. 1, each of the slots 26 are in communication with the surface opposite the end surface 24 via oval shaped apertures 40 defined in the bottom of the slots 26. Furthermore, each of the adaptors 30 are shown as defining a threaded aperture 42. Finger tightened, threaded lock screws 44 may be inserted axially through the apertures 40 in the wrench body 22 and into the apertures 42 of the adaptors 30. A head portion 44*a* engages the end surface opposite the end surface 24 to fixedly secure the adaptors 30 at a selected location along slots 26.

Threadably and removably attached to the periphery of the wrench body 22 and extending laterally therefrom so as to be longitudinally aligned are wrench handles 36. Positioned at the end of the handles 36 are handle grips 38.

Shown in FIG. 6 is a perspective of the spanner wrench 20 of the present invention being utilized to remove the retaining nut of a cartridge type shock absorber assembly 50. As illustrated, the user is able to grasp both of the handles 36 so as to apply the appropriate torque to loosen or tighten the retaining nut.

Figure 10:
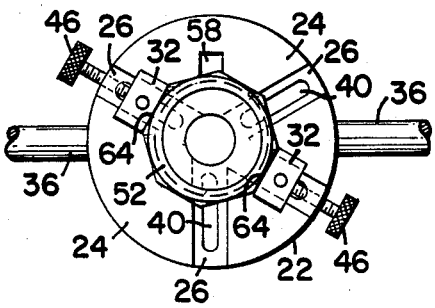
FIG. 10 is a fragmentary top plan view illustrating use of the adaptor members shown in FIG. 3 with a flat retaining nut.

Additionally, finger tightened, threaded adjustment screws 46 configured for threaded receipt in radially directed threaded apertures in alignment with the slots 26 may be utilized to facilitate radial positioning of the adaptors 30 particularly, when the adaptors 30 are utilized with flat sided retaining nuts as generally shown in FIG. 10. The adjustment screws 46 are threaded through the threaded apertures so as to engage the lock screws 44 thereby further securing the adaptors 30 against radially outwardly movement due to pressure being exerted thereon by the retaining nut being operated on. In the preferred embodiment only the two aligned slots 26 have the threaded apertures as these are generally the slots 26 whose adaptors 30 are utilized on flat sided retaining nuts.

As illustrated, the wrench body 22 of the preferred embodiment further includes an axially directed, square aperture 58 extending from the retaining nut end surface 24 to the opposite end surface. The aperture 58 is positioned intermediate of the center aperture 28 and the periphery of the wrench body 22. The aperture 58 is configured for receipt of a conventional torque wrench (not shown) such that the retaining nut can be accurately tightened to the manufacturer's torque specifications.

Figure 8:
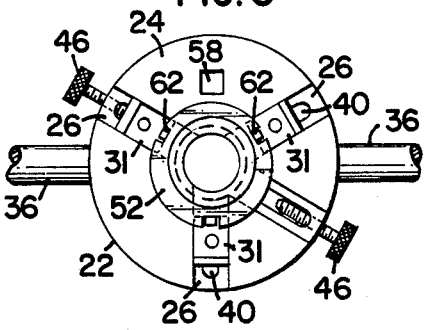
FIG. 8 is a fragmentary top plan view illustrating use of the adaptor members shown in FIG. 2 with an external notch type retaining nut.
Figure 9:
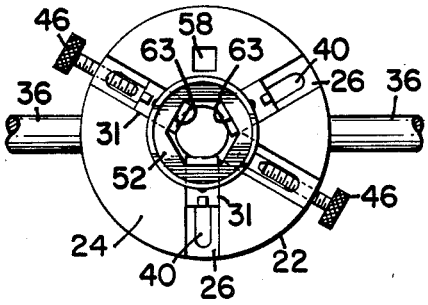
FIG. 9 is a fragmentary top plan view illustrating use of the adaptor members shown in FIG. 2 with an internal hex-shape retaining nut.
Figure 11:
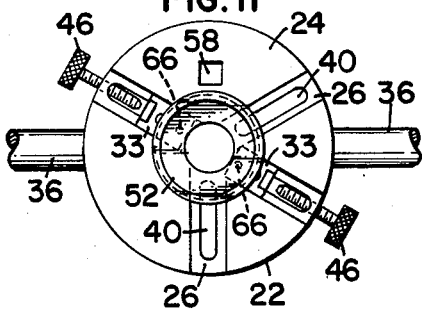
FIG. 11 is a fragmentary top plan view illustrating use of the adaptor members shown FIG. 4 with a retaining nut having axially directed openings.
Figure 12:
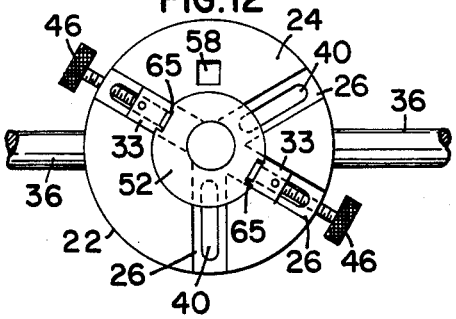
FIG. 12 is a fragmentary top plan view illustrating use of the adaptor members shown in FIG. 4 with an external notch type retaining nut.
Figure 13:
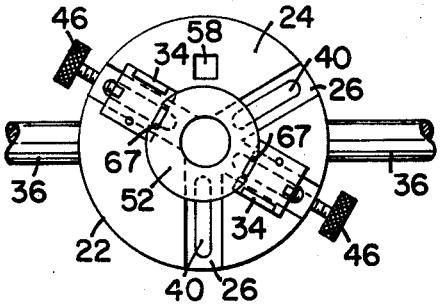
FIG. 13 is a fragmentary top plan view illustrating use of the adaptor members shown in FIG. 5 with an external notch type retaining nut.

Illustrated in FIGS. 7 through 13 are selected ones of the adaptors 30 being utilized in conjunction with the wrench body 22 to facilitate use with varying configurations of retaining nuts 52. As illustrated, the present invention provides a single wrench body 22 which through the use of various adaptors 30 enables service on a wide variety of retaining nut configurations and accordingly a wide variety of cartridge type shock absorber assemblies. As illustrated in FIGS. 7 through 13, some of the various configurations of retaining nuts which the spanner wrench of the present invention may be utilized with include external notch type retaining nuts as generally shown in FIGS. 8, 12, and 13, internal notch type retaining nuts as generally shown in FIG. 7, flat sided retaining nuts as generally shown in FIG. 10, internal hex-shaped retaining nuts as generally shown in FIG. 9, and retaining nuts having axially directed bores or openings as generally shown in FIG. 11. Additional features of the slots 26 and the complementary adaptors 30 will now be described.

As illustrated the slots 26 are of substantially uniform width and depth throughout. Additionally, the slots 26 have the same general configuration such that a given adaptor member can be utilized in any of the slots 26. The apertures 40 providing communication to the opposite end surface of the wrench body 22 are of lesser width and length than the slots 26. Accordingly, the apertures 40 are sufficiently wide to enable the threaded lock screws 44 to project therethrough but yet narrower than the adaptors 30 such that the adaptors 30 are supported in the slots 26.

In one embodiment of the present invention, three interchangeable sets of adaptors 31, 32, and 33 as shown in FIGS. 2 through 4 will be utilized in conjunction with the cylindrical wrench body 22. The adaptors 31 include a slot following, rectangular base portion 31*a* only slightly less wide than the slots 26 so as to enable sliding movement therealong and yet prohibit sideways movement. The base portion 31*a* has a thickness such that when positioned in the slots 26, a top surface 31*b* thereof does not project beyond the end surface 24 but is essentially flush therewith or slightly recessed. Positioned at opposite ends of the adaptor 31 are two lug elements 31*c* and 31*d* configured to engage varying configurations of retaining nuts as shown generally in FIGS. 7 through 9. The lug element 31*c* projects axially beyond the end surface 24 of the wrench body to engage either internally or externally notched type retaining nuts at locations 61 and 62 respectively by simply varying the radial positioning of the adaptors 31. Similarily, the lug element 31*d* projects axially to engage the alternating flat sides 63 of internally hex-shaped retaining nuts as generally shown in FIG. 9.

The adaptor 32 is generally T-shaped to include a slot following, rectangular base portion 32*a* and a flat sided retaining nut engagement portion 32*b* which slides on top of the surface 24 of the wrench body 22. The adaptors 32 are utilized with retaining nuts having external flat sides 64 as generally illustrated in FIG. 10. Furthermore, as illustrated in FIG. 10, the adaptors 32 are further held in place by the laterally directed adjustment screws 46 engaging the axially directed lock screws 44 for reasons as previously discussed.

The adaptors 33 include a slot following, rectangular base portion 33*a* similar to the base portion 31*a* of the adaptors 31. The base portion 33*a* includes a top surface 33*b* which does not extend axially beyond the end surface 24 of the wrench body 22 and which is generally flush therewith or slightly recessed therein. The adaptor 33 includes two lug elements 33*c* and 33*d* at opposite ends which project axially so as to engage external or internal notches of retaining nuts as generally illustrated in FIG. 12 wherein a retaining nut having external notches 65 is shown and retaining nuts having blind bores or cylindrical apertures 66 extending axially of the retainer nut 52 as generally illustrated in FIG. 11.

As illustrated in FIGS. 7 through 12 the three sets of interchangeable adaptors 31, 32, 33 enable use of the spanner wrench 20 with a wide variety of retaining nut configurations not all of which are necessarily shown. It will be appreciated varying combinations of the adoptors 31, 32, 33 and alternately configured adaptors might be utilized to provide the spanner wrench with adaptability to retaining nuts developed in the future.

In the preferred embodiment of the present invention, the single set of adaptors 34 provide the spanner wrench with essentially the same versatility as the interchangeable sets 31, 32, and 33. In this embodiment, the adaptors 34 have a slot following square base portion 34*a* which enables the adaptors 34 to be oriented in any one of four directions within the slots 26. Positioned on top of the base portion 34*a* is a support portion 34*b* which axially projects beyond the surface 24 of the wrench body and slides thereon. Positioned along the four sides of the support portion 34*b* are lug elements 34*c*, 34*d*, 34*e* and 34*f* respectively. It will be appreciated that while the adaptors 34 are shown in FIG. 3 being utilized with an external notch type retaining nut having external notch locations 67, the adaptors 34 may be utilized with any of the retaining nut configurations illustrated in FIGS. 7 through 12 and others not shown. Accordingly, in this embodiment only one set of the adaptors 34 is required to enable the spanner wrench of the present invention to be utilized with a wide variety of retaining nuts some of which are illustrated in FIGS. 7 through 13. As illustrated in FIG. 13, in this embodiment the retaining nut will engage the support portion 34*b* above the surface of the end surface 24. In an alternate embodiment of the adaptor 34, one of the lug elements such as element 34*f* might be removed to provide a relatively smooth, flat surface for use on externally flat sided retaining nuts.

It is to be understood, however, that even though numerous characteristics and advantages of the invention have been said forth in the foregoing description, together with the details of the structure and function of the invention, the disclosure is illustrative only and changes may be made in detail, especially in matters of shape, size, arrangement of parts within the principles of the invention, to the full extent indicated by the broad general mounting of the terms in which the appended claims are expressed.

What is claimed is:

1. A spanner wrench for use in removing and replacing a retaining nut of a cartridge type shock absorber type assembly, said wrench comprising:

(a) a cylindrical wrench defining a substantially flat retaining nut facing end surface and a second end surface opposite therefrom, said wrench defining an axially directed aperture proximate the center thereof;

(b) two elongated handles interconnected to and extending laterally outwardly from the periphery of said cylindrical wrench body;

(c) four radially extending slots defined in said retaining nut facing end surface of said cylindrical wrench body, three of said radially extending slots being angularly displaced from one another by substantially one hundred twenty (120) degrees, a fourth of said slots being angularly displaced from two of said three slots on either side of said fourth slot by substantially sixty (60) degrees, said fourth slot being radially aligned with the third of said three slots;

(d) a plurality of adaptor members configured for removable receipt in said slots, said adaptor members being radially slideable in said slots, said adaptor members including differing retaining nut engaging portions at opposite ends thereof, said adaptor members being reversible end for end within said slots to enable either of said retaining nut engaging portions to engage said retaining nut being operated on; and (e) means cooperating with said wrench body for releasably securing said adaptor members at selected locations along said slots radially removed from the center of said wrench body, said securing means including axially directed threaded thumb screws which are finger tightened and loosened.

2. A spanner wrench in accordance with claim 1, wherein said thumb screws are threaded into threaded apertures of said adaptor members, said thumb screws being threaded into said adaptor members from the end surface opposite said retaining nut facing surface of said wrench body, said thumb screws projecting through radially extending apertures generally in alignment with and of lesser width than said slots.

3. A spanner wrench in accordance with claim 1, said adaptor members including a substantially square slot following portion and further including a differing retaining nut engaging element along each side of said adaptor members, said substantially square slot following portion enabling said adaptor members to be rotated about an axis parallel to the axis of said wrench body and positioned at any one of four positions angularly displaced from one another but by ninety (90) degrees.

4. A spanner wrench in accordance with claim 1, said spanner wrench further including an axially directed, rectangular opening positioned in said retaining nut facing end surface of said wrench body, said rectangular opening being positioned radially outward from the center of the wrench body, said rectangular opening providing for removable receipt of a conventional torque wrench or the like, wherein the retaining nut may be accurately tightened to a specified torque valve.

5. A spanner wrench for use in removing and replacing a retaining nut of a cartridge type shock absorber assembly, said wrench comprising:

(a) a cylindrical wrench body defining a retaining nut facing end surface and a second end surface opposite therefrom, said wrench body defining an axially directed aperture proximate the center thereof;

(b) two elongated handles interconnected to and extending laterally outwardly from the periphery of said cylindrical wrench body;

(c) a plurality of radially extending slots defined in the retaining nut facing end surface of said cylindrical wrench body;

(d) a plurality of adaptor members configured for removable receipt in said slots, said adaptor members being radially slideable in said slots, said adaptor members each including a plurality of retaining nut engaging portions, said adaptor members having a substantially square slot following portion, said slot following portion enabling said adaptor members to be positioned within the slots at any one of four orientations, said orientations being angularly displaced from one another by substantially 90 degrees so as to present any one of four sides of said adaptor members for engagement with said retaining nut being operated on.

* * * * *